United States Patent [19]

Frisby

[11] Patent Number: 4,781,801

[45] Date of Patent: Nov. 1, 1988

[54] METHOD OF COPPER PLATING GRAVURE ROLLS

[75] Inventor: C. Richard Frisby, Strongsville, Ohio

[73] Assignee: McGean-Rohco, Inc., Cleveland, Ohio

[21] Appl. No.: 10,212

[22] Filed: Feb. 3, 1987

[51] Int. Cl.[4] ..... C25D 7/00

[52] U.S. Cl. ..... 204/25; 204/52.1

[58] Field of Search ..... 204/52.1, 25

[56] References Cited

U.S. PATENT DOCUMENTS

| | | | |
|---|---|---|---|
| 3,542,655 | 11/1970 | Kardos et al. | 204/52.1 |
| 3,682,788 | 8/1972 | Kardos et al. | 204/52.1 |
| 3,798,138 | 3/1974 | Ostrow et al. | 204/52.1 |
| 4,014,760 | 3/1977 | Kardos et al. | 204/52.1 |
| 4,334,966 | 6/1982 | Beach et al. | 204/25 |
| 4,376,685 | 3/1983 | Watson | 204/52.1 |
| 4,512,007 | 4/1985 | Knothe et al. | 369/127 |

*Primary Examiner*—G. L. Kaplan

*Attorney, Agent, or Firm*—Fay, Sharpe, Beall, Fagan, Minnich & McKee

[57] ABSTRACT

A method of electropolating a layer of copper on gravure rolls is provided with the so-plated layer being especially adapted to receive electronic engraving. The method comprises the steps of placing a gravure roll in an electroplating bath comprising from about 150 to about 225 g/l of copper sulfate as pentahydrate, from about 35 to about 90 g/l of sulfuric acid, from about 0.01 to about 1.0 g/l of a polyether surfactant having a molecular weight of from about 400 to about 10,000, from about 1 to about 100 mg/l of a sulfonated, sulfurized benzene brightener compound, and about 0.5 to about 5 mg/l of a grain refining compound having the nucleus

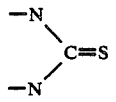

in a heterocyclic ring structure, and a molecular weight between about 100 and about 180.

8 Claims, No Drawings

METHOD OF COPPER PLATING GRAVURE ROLLS

BACKGROUND OF THE INVENTION

The present invention relates to electroplating gravure rolls with a surface layer of copper. More particularly, it concerns the use of a unique plating bath formulation which results in a surface coating that is ideally suited for electronic engraving.

Gravure printing is a method using the Intaglio process in which the image to be printed consists of depressions etched or engraved usually to different depths. Slightly viscous solvent inks are applied to the entire surface and a metal doctor blade removes the excess ink from the non-printing surface. Normally engraving is performed on a copper plated cylinder which is subsequently chrome plated to minimize wear.

A problem in gravure cylinder making is the difficulty in producing cylinders having surface properties which are identical from cylinder to cylinder. Surface defects such as roughness, pits or spots which are too hard or too soft result in engraving errors and the subsequent need for repolishing and replating which is expensive and time consuming.

The properties of the plated copper deposits have not been considered important for this application when chemical etching has been the engraving procedure. However, since the development of the automatic method of electronic engraving, the electrodeposition of copper of known physical and mechanical properties with reproducible grain size, crystal structure and hardness over the entire surface of the roll has become very important.

Prior art acid copper plating processes are primarily directed toward decorative plating where the objective is to impart leveling and brightness characteristics with little regard to the precise physical properties that are so important for electronic engraving. Such decorative applications are generally concerned with deposits ranging in thickness from about 0.0005 to about 0.0015 in. while gravure rolls require deposits ranging from 10 to 20 times these thickness values.

Copper plating applied to gravure cylinders from processes designed for decorative applications tends to produce grain structures and hardness values not suitable for electronic engraving. These copper deposits may show the initial requisite hardness value but within a short period of time, undergo spontaneous structural changes (often referred to as annealing) so that the deposit is too soft for commercially acceptable electronic engraving.

Attempts to overcome the annealing problem with higher concentrations of the constituents typically used for decorative acid copper plating, such as thiourea and mercapto compounds, result in deposits that are too hard and brittle.

Electronic engraving is a means of transferring an image for printing to a copper electroplated cylinder by directing a diamond-pointed stylus to form as many as 4,000 ink-receiving impressions every second. This sophisticated technique requires copper deposits of very definite properties to prevent engraving defects and costly damage to the expensive equipment. It is essential that the deposited copper have a homogeneous fine-grained crystal structure that is free of nodulations and occlusions with excellent ductility and uniform hardness. A critical factor is the control and uniformity of hardness since the stylus pressures are set with references to a given Vickers hardness value and if this is not uniform over the entire surface, it will result in smearing or ripping of the deposit and badly defined impressions for printing.

In order to produce the required thick deposits in a reasonable plating time, current densities must be employed in the range of 100 to 200 amperes per square foot or higher, much higher than decorative acid copper plating which is usually accomplished at 25 to 50 amperes per square foot.

The gravure cylinders may be plated either partially or fully submerged, the deposition rate being related to the immersion depth. An acid copper process which has been used to plate partially immersed cylinders is disclosed in U.S. Pat. No. 4,334,966. An important advantage realized by increasing the immersion depth is a decrease in plating time which has obvious economic advantages.

When a cylinder is plated partially immersed, i.e. to about 30% of its diameter, as compared to a cylinder that is plated totally submerged, the deposit characteristics are apparently influenced by the fluctuations of the current and composition differences in the cathode film. In any event, plating baths are known to perform differently with respect to the immersion depth. The principal problem in this regard is annealing or the tendency of the hardness of the copper deposit to decrease with time as a result of changes in crystallite size, texture, microdeformations and dislocations within the copper deposit. This problem of recrystallization (annealing) is characteristic of totally submerged cylinder operations when using a bath designed for partial immersion.

The comparative success of the different processes has been related to the engravability of the deposit as well as the ease of the operation and control of the plating bath. Thiourea has been used in additive systems to overcome the annealing problem experienced when plating fully submerged cylinders. However, such systems require the plating bath to be so nearly free of chloride ions that especially pure reagents and deionized water are needed. Moreover, these systems are prone to inclusions, e.g., hard radial structures localized within the deposit, and generally lack the desired uniformity necessary for quality engraving.

There remains, therefore, a need for an acid copper plating process which can be used to deposit a copper layer of uniform hardness and stability, which is suitable for electronic engraving, on rolls which are plated while completely or nearly completely submerged in the plating bath.

SUMMARY OF THE INVENTION

In one aspect, the present invention concerns a method of electroplating on a gravure roll a layer of copper which is especially suited to receive electronic engraving comprising the steps of submerging a gravure roll in an electroplating bath including from about 150 to about 225 g/l of copper sulfate pentahydrate, from about 35 to about 90 g/l of sulfuric acid, from about 0.01 to about 1.0 g/l of a polyether surfactant having a molecular weight ranging from about 400 to about 10,000, from about 1 to about 100 mg/l of sulfonated sulfurized brightener compound, and from about 0.5 to about 5.0 mg/l of a grain refining compound having a nitrogen heterocyclic ring structure; and passing electrical current through the bath to deposit copper on the gravure roll.

In order to achieve high deposition rates and develop a uniform deposit, the roll is normally rotated on its axis to develop a surface speed of about 300 ft/min (SF/min.).

In another aspect, the instant invention relates to an additive composition adapted to be used to form a bath for electrodepositing a gravure roll with a layer of copper which is especially suited for electronic engraving with the additive composition comprising a solution of a sulfonated, sulfurized benzene brightener compound, a polyether surfactant and a grain refining compound in an effective amount to give the desired results when added to the plating bath.

The grain refining compound has a nucleus

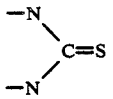

which is preferably embodied in a heterocyclic ring structure of carbon atoms. Examples of useful grain refining compounds are 2-imidazolidinethione, (MW102.17) 1,1-thiocarbonyldiimidazole (MW178.22) and 2-thiohydantoin (MW116.14).

DESCRIPTION OF THE PREFERRED PRACTICE OF THE INVENTION

The bath of this invention is formed by combining the above-described additive composition with a solution containing from about 150 to about 225 g/l of copper sulfate pentahydrate and from about 35 to about 90 g/l of sulfuric acid and a very small quanitity of chloride ion.

The polyether utilized is desirably a polyethylene oxide material having a molecular weight in the range of from about 4,000 to 10,000 or, preferably, a polypropylene oxide material with a molecular weight in the range of about 400 to 1,000. In the bath as little as about 0.01 g/l will be effective and a substantial excess of up to about 1 g/l may be employed. A preferred quantity is about 0.08 g/l. Suitable polyether compounds are disclosed in U.S. Pat. No. 3,328,273. These compounds can be illustrated by the following structural formula:

$$R—(CH_2CH_2O)_2H,$$

where $R = C_2H_5O—$, $HOC_2H_4O—$, and

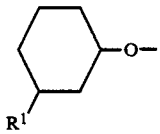

(where $R^1 = C_2$–$C_{12}$). (linear, branched, saturated, unsaturated)

One such compound is Pluracol surfactant P-710 manufactured by BASF Wyandotte Corporation.

It is necessary to maintain a balance of certain additives which function together in order to provide a deposit that is (1) free of treeing or growth at the high current density ends of the cylinder, (2) has a uniform crystal structure of the desired hardness value throughout the thickness and lenth of the deposit, and (3) does not anneal.

According to the practice of the present invention, the combination of additives found to achieve this goal is dependent upon the use of a specific class of compounds selected to suppress annealing while preserving other desirable qualities of the deposit. These materials differ from other compounds used heretofore for this purpose in that they have a heterocyclic structure. Though the exact mechanism of their operation is not fully understood, it is thought that the adsorption of the additive inhibits the electrodeposition process to favor a preferred deposit growth orientation that is not subject to recrystallization. Such commands are water soluble or water dispersible and are illustrated by the structure

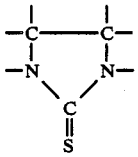

where the double bonded sulfur and the ring structure are essental for the suppression of annealing without the formation of undesirable electrolysis products. Superior performance is obtained when the described structure is used in combination with a sulfonated, sulfurized benzene brightener compound and a polyether surfactant such as polypropylene oxide.

A preferred compound within the scope of the invention is 2-imidazolidinethione which has the following general structure.

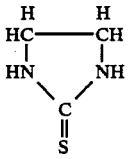

Another related compound within the scope of the invention is 1,1'-thiocarbonyldiimidazole. This compound has the following general structure.

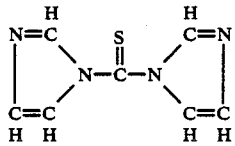

Another preferred compound is 2-thiohydantoin. This compound has the following general structure.

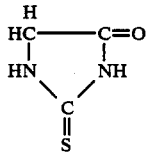

The grain refining compound is present in the bath in an effective quantity ranging from about 0.5 mg/l to about 5.0 mg/l. Too large an amount causes brittleness, too little does not adequately control crystal growth. A preferred amount in the bath is about 3 mg/l.

A composition similar to the sulfonated, sulfurized benzene brightener compound as disclosed in U.S. Pat. No. 2,424,887 is employed in the bath in range of from about 1 mg/l to about 100 mg/l. A preferred quantity is about 20 mg/l.

The bath should contain from about 20 to about 80 ppm of chloride ion, preferably about 50 ppm which may be added as hydrochloric acid.

The plating is applied to the roll with the plating bath at a temperature ranging from about 70° F. to about 120° F., preferably at about 75°-90°F. Current may be from about 60 to about 450 A/sq. ft. of roll surface, preferably about 150-250 A/sq. ft. Plating is continued until the deposit is at least about 15 mils (0.015 inch) thick. The deposit typically has a Rockwell T hardness of about 91 to about 92 as plated with no loss after standing at room temperature for a prolonged period of time.

Higher temperatures may be employed but at the expense of greater cost due to the increased concentration and consumption of the additives necessary to produce the desired results.

Ductility of the deposit is determined on the foil by flexing it 180 degrees. A ductile foil will fold whereas a brittle foil will break.

The present invention will be better under stood from the following examples which are intended to be illustrative and not limiting.

REFERENCE EXAMPLE A

A plating bath was prepared containing 210 g/l of copper sulfate pentahydrate, 60 g/l of sulfuric acid, 50 ppm of chloride added as hydrochloric acid, 20 mg/l of benzene sulfonate disulfide, and 80 mg/l of polyether surfactant (Pluracol P-710). A copper gravure roll six inches long and two inches in diameter was plated completely submerged in the bath at 80° F. at a current density of 150 A/sq. ft. while being rotated at 300 SF/min. to produce a copper deposit, 0.005 inch thick, which had a Rockwell T hardness of 88 and a Vickers hardness of 168. The anodes employed in the plating procedure were phosphatized copper and had an area of 86 square inches and were spaced 1 inch from the rotating cathode roll.

The deposit of copper so obtained had a grainy matte surface with a semi-bright appearance in the extreme high current density areas. The copper deposit was removed from the cylinder as a Ballard foil after the hardness value of 168 Vickers for the as-plated copper was obtained. A cross sectional examination of various areas of the copper foil indicated a uniform amorphous structure. The deposit was very ductile as determined by flexing the foil 180 degrees.

Sixty-three hours after the plated value of 168 Vickers was obtained, a sample of the copper deposit of Reference Example 1 was tested and found to have annealed at room temperature to a Vickers hardness of 136. This test is indicative of copper deposits that are unsuitable for electronic engraving, particularlry when storage periods are a consideration. Such copper deposits may vary in the rate at which they anneal when stored at room temperature from several hours to several weeks. A sample of the deposit also annealed to a Vickers hardness of 136 when it was subjected to an accelerated annealing test by heating it to 100° C. for 1 hour.

REFERENCE EXAMPLE B

The bath of Reference Example A was modified by the addition of 3 mg/l of thiourea and a gravure roll was then plated using the same plating bath and parameters. The deposit of copper so obtained had a bright surface with some treeing in the high current density region at the edges of the roll. The deposit was 0.005 of an inch thick and as plated had a Rockwell hardness of 92 and a Vickers hardness of 218. The deposit indicated some brittleness when the removed foil fractured as it was flexed 180 degrees. A cross sectional examination showed non-uniformity in the deposit structure with areas of varying hardness values exhibited as radial inclusions. A sample of the deposit annealed to a Vickers hardness of 145 when it was subjected to an accelerated annealing test at 100° C. for 1 hour. It similarly annealed at room temperature. It was further determined that increased concentrations of thiourea tended to delay the annealing rate of subsequent cylinders plated at the same parameters in the bath of Reference Example B, but the deposits obtained were of such brittleness that the resultant foils shattered.

EXAMPLE I OF THE INVENTION

The bath of Reference Example A was modified by the addition of 3 mg/l of 2-imidazolidinethione and a gravure roll was then plated therein using the same operating parameters. The deposit of copper so obtained had a bright surface with only slight high current density edge effects. The deposit was 0.005 of an inch thick and as plated had a Rockwell hardness of 92 and a Vickers hardness of 220. The deposit exhibited good ductility when the foil was removed from the roll and readily flexed 180 degrees. The cross sectional examination of the deposit showed the grain structure to be completely uniform and very compact with a significant reduction in grain size. A sample of the deposit did not anneal when it was subjected to the heretofore described accelerated annealing test. Copper deposits produced as above described, did not anneal at room temperature on samples which were monitored more than one year.

EXAMPLE II OF THE INVENTION

A plating bath was prepared as in Example I of the Invention and a gravure roll was plated using the same plating parameters to obtain a deposit 0.015 inches thick that had a Rockwell T hardness of 92 and a Vickers hardness of 220. A portion of the deposit on the cylinder demonstrated good engravability by the electronic method, the balance being reserved for a later test. The partially engraved roll was then stored at room temperature for six months after which time its hardness was 92 Rockwell T and 220 Vickers. After such storage the remaining portion of the roll was as equally well engraved by the electronic method.

EXAMPLE III OF THE INVENTION

The bath of the Reference Example A was modified by the addition of 3 mg/l of 2-thiocarbonylidiimidazole and a gravure roll was plated using the same plating parameters. The deposit of copper so obtained had a bright surface with very smooth high current density edges. The deposit which was 0.005 of an inch thick and had a Rockwell hardness of 92 and a Vickers hardness of 219. The deposit exhibited excellent ductility when the removed foil was flexed 180 degrees. A very uniform and compact grain structure similar to that obtained in Example I was determined by microscopic cross sectional examination. A sample of the deposit did not anneal when it was subjected to the accelerated annealing test.

EXAMPLE IV OF THE INVENTION

A bath of Reference Example A was modified by the addition of 3 mg/l of 1,1'-thiocarbonyldiimidazole and a gravure roll was plated using the same parameters. The deposit of copper so obtained had a bright appearance with smooth high current density edges. The deposit was 0.005 of an inch thick and as plated had a Rockwell hardness of 92 and a Vickers hardness of 217. The deposit was found to be very ductile when the removed foil was flexed 180 degrees. A cross section examination indicated a uniform amorphous structure. A sample of the deposit annealed to a Vickers hardness of 136 when it was subjected to an accelerated annealing test. It similarly annealed at room temperature.

It was further determined by increasing the concentration of the 1,1'-thiocarbonyldiimidazole by a factor of 10 that non-annealing but very brittle deposits were obtained from subsequent cylinders plated using the same parameters in the bath of example IV. These subsequent deposits had a semi-bright appearance with narrow bright bands at the extreme high current density areas. The deposit was 0.005 of an inch thick and had varied hardness values of 89 Rockwell T and 187 Vickers in the semi-bright area to 92 Rockwell T and 187 Vickers in the bright bands. A cross sectional examination noted a lack of uniformity in the deposit structure characterized by an amorphous structure in the bright bands which was altered in the semi-bright areas by dense vertical grain alignment. Samples of the deposits from the semi-bright areas did not anneal when subjected to the accelerated annealing tests, but samples of the deposits from the bright bands did anneal when similarly tested.

EXAMPLE V OF THE INVENTION

A plating bath was prepared containing 210 g/l of copper sulfate pentahydrate, 60 g/l of sulfuric acid and 50 ppm of chloride added as hydrochloric acid. A first premixed make-up additive package (A) was formulated to contain 3.8 g of benzene sulfonate disulfide and 10 g of polyethylene oxide (Pluronic P-710). Premix concentrate (A) was then added to the above-described bath to give a concentration of 0.5% of premix concentrate (A) in the bath. A second premix concentrate (B) was made up to contain 1 g of benzene sulfonate disulfide, 30 g of polyether surfactant (Pluronic P-710) and 3 g of 2-imidazolidinethione and was added to the bath in an amount sufficient to give a 0.15% concentration of premix concentrate (B) in the bath. A copper gravure roll was plated completely submerged at 80° F. at 150 A/sq. ft. while being rotated at 300 SF/min. to produce a deposit, 0.020 of an inch thick, which had a Rockwell T hardness of 92 and a Vickers hardness of 220. The deposit on the cylinder demonstrated good engravability by the electronic method. The deposit hardness did not changed from the as-plated values for the presently monitored period of five months.

In practice, premix concentrate (B) can be used as make-up or maintenance additive to help regulate the composition of the used plating bath. This is accomplished by adding the desired amount of premix concentrate (B) to the plating bath to maintain it within the operational parameter set forth herein. In this regard, the concentration of the individual components of premix concentrate (B) can be varied as long as the relative amounts used result in a premix which can be used to produce a bath having the hereinbefore set forth ranges of ingredients.

It should be noted that the bath of Example V had been tested under commercial conditions. The bath has been operated continuously as a two shift operation as well as a three shift operation with weekend shutdown periods of one to two days. Over a current density range of 1 to 3 A/sq. in. and a temperature range of 75° to 105° F. at various levels of cylinder submersion, including total immersion, the bath has produced copper deposits for electronic engraving that do not anneal.

As will be seen from the foregoing the present invention relates to a combination of features as opposed to any one individual aspect of the total innovation. For example, while the practice of the instant invention requires the use of a special and highly specific grain refining compound having the structural formula and molecular weight described hereinbefore, such a compound must be utilized within the compositional and operational plating bath parameters set forth herein. The following table together with the foregoing data illustrates this point.

GRAVURE ROLL SAMPLES

| PANEL | 2-1 | 2-2 | 2-3 | 2-4 | 6-1 | 6-2 | 6-3 | 6-4 | 6-5 | 6-6 | The Invention (Example V) |
|---|---|---|---|---|---|---|---|---|---|---|---|
| $CuSO_4.5H_2O$ | 28 o/g | | | | 28 o/g | | | | | | See Example V for details of composition used |
| $H_2SO_4$ | 8 o/g | | | | 8 o/g | | | | | | |
| CHLORINE | 50 ppm | | | | 0 | | | | 0.1 cc/l | | |
| 2-THIOHYDANTOIN | 0 | 0.05 g/l | .0067 | | | 0.05 | | | | | |
| CITRIC ACID | | | 1.87 g/l<br>0.25 o/g | | | | 1.87 g/l<br>0.25 o/g | | | | |
| DEXTRIN | | | | 1.87 g/l | | | | 0.25 o/g | | | |
| PREMIX A | | | | | | | | | | 20 ml/l | |
| RESULTS | smooth satin | bright HCD/ streaky | bright HCD/ streaky | grainy/ less streaky | satin/ rough HCD | bright HCD/ dull | rough HCD/ dull | as 6-3 but dull | dull HCD & LCD bright | very bright HCD/mid LCD/semi- | full bright |

-continued

GRAVURE ROLL SAMPLES

| PANEL | 2-1 | 2-2 | 2-3 | 2-4 | 6-1 | 6-2 | 6-3 | 6-4 | 6-5 | 6-6 | The Invention (Example V) |
|---|---|---|---|---|---|---|---|---|---|---|---|
| | | | | | | LCD | LCD | | MCD | bright MCD | |

g/l × 0.134 – 0/gal
o/g = ounces/gallon
g/l = grams/liter
HCD = High Current Density
MCD = Mid Current Density
LCD = Low Current Density In the above table a series of Hull cell test panels were plated using various plating bath compositions. As is noted, test panel 2—2 which was plated in a bath containing 2-thiohydantoin, a compound used in the practice of the present invention, did not produce a satisfactory deposition in that it was bright in the high current density but streaky. In contradistinction thereto, the test panel Example V, produced according to the practice of the instant invention was highly satisfactory in that it was fully bright.

While there have been described what are at present considered to be the preferred embodiments of this invention, it will be obvious to those skilled in the art that various changes and modifications may be made therein without departing from the invention, and, it is, therefore, intended in the appended claims to cover all such changes and modifications as fall within the true spirit and scope of the invention.

What is claimed is:

1. A method of depositing on a gravure roll a layer of copper which does not significantly anneal upon aging and is especially adapted to receive electronic engraving, said method comprising the steps of submerging a gravure roll in an electroplating bath including from about 150 to about 225 g/l of copper sulfate as pentahydrate, from about 35 to about 90 g/l of sulfuric acid, from about 0.01 to about 1.0 g/l of a polyether surfactant having a molecular weight from about 400 to about 10,000, from about 1 to about 100 mg/l of a sulfonated, sulfurized benzene brightener compound and about 0.5 to about 5.0 mg/l of a grain refining compound having the nucleus

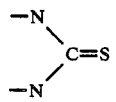

in a heterocyclic ring structure, and a molecular weight between about 100 and about 180; and passing electrical current through the bath to deposit copper on the gravure roll.

2. A process according to claim 1 wherein said polyether surfactant is present in an amount of about 80 mg/l, said grain refining compound is present in an amount of about 3 mg/l, and said benzene brightener compound is present in an amount of about 10 mg/l.

3. A process according to claim 1 wherein a current of from about 60 to about 450 A/sq.ft. is applied to the surface of the gravure roll to deposit about 0.015 inch of copper thereon.

4. A process according to claim 3 wherein the bath is operated at a temperature in the range of from about 70° to about 120° F.

5. A process according to claim 1 wherein the bath contains from about 20 to about 80 ppm of chloride.

6. A process according to claim 1 wherein the grain refining compound is 2-imidazolidinethione.

7. A process according to claim 1 wherein the grain refining compound is 2-thiohydantoin.

8. A process according to claim 1 wherein the grain refining compound is 1,1'-thiocarbonyldiimidazole.

* * * * *